US007133011B2

(12) United States Patent
Ha

(10) Patent No.: US 7,133,011 B2
(45) Date of Patent: Nov. 7, 2006

(54) DATA DRIVING CIRCUIT OF LIQUID CRYSTAL DISPLAY DEVICE

(75) Inventor: Yong Min Ha, Kyonsangbuk-do (KR)

(73) Assignee: LG. Philips LCD Co., Ltd, Seoul (KR)

( * ) Notice: Subject to any disclaimer, the term of this patent is extended or adjusted under 35 U.S.C. 154(b) by 0 days.

(21) Appl. No.: 10/034,185

(22) Filed: Jan. 3, 2002

(65) Prior Publication Data

US 2002/0113762 A1 Aug. 22, 2002

(30) Foreign Application Priority Data

Feb. 19, 2001 (KR) ..... P2001-8176

(51) Int. Cl.
*G09G 3/36* (2006.01)

(52) U.S. Cl. ..... 345/87; 345/98; 345/99

(58) Field of Classification Search ..... 345/87–90, 345/92, 98–103, 204–205, 214, 215; 341/100, 341/141, 144

See application file for complete search history.

(56) References Cited

U.S. PATENT DOCUMENTS 5,714,953 A * 2/1998 Mitani et al. ..... 341/144
6,356,223 B1 * 3/2002 Tanaka ..... 341/144
6,373,459 B1 * 4/2002 Jeong ..... 345/100
6,452,526 B1 * 9/2002 Sagawa et al. ..... 341/144
6,577,293 B1 * 6/2003 Kwon ..... 345/89
6,661,401 B1 * 12/2003 Sekine ..... 345/92
6,744,415 B1 * 6/2004 Waterman et al. ..... 345/87
6,850,218 B1 * 2/2005 Waterman ..... 345/103
2004/0075633 A1 * 4/2004 Yoshida ..... 345/98

* cited by examiner

*Primary Examiner*—Richard Hjerpe
*Assistant Examiner*—Mansour M. Said
(74) *Attorney, Agent, or Firm*—McKenna, Long & Aldridge

(57) ABSTRACT

A data driving circuit of an LCD device includes a timing controller for formatting input data so that data and gate drivers of an LCD panel display a picture image, and outputting a selection signal; a plurality of digital to analog converters for converting digital signals output from the timing controller to analog signals based on a color gray level displayed; and a plurality of amplifiers for amplifying the signals output from the respective digital to analog converters and outputting the amplified signals to the LCD panel.

7 Claims, 4 Drawing Sheets

DATA DRIVING CIRCUIT OF LIQUID CRYSTAL DISPLAY DEVICE

This application claims the benefit of Korean Patent Application No. P 2001-8176 filed in Korea on Feb. 19, 2001, which is hereby incorporated by reference.

BACKGROUND OF THE INVENTION

1. Field of the Invention

The present invention relates to a liquid crystal display (LCD) device, and more particularly, to a data driving circuit of an LCD device that displays an image signal by driving a digital to analog converter based on a color gray level displayed, thereby reducing power consumption.

2. Discussion of the Related Art

In general, LCD devices have been widely used for monitors of portable electronic devices such as notebook computers, mobile phones, and personal data accessories. An LCD device typically includes an LCD panel and a data driving circuit. The LCD panel displays image signals, and the data driving circuit applies driving signals from the outside to the LCD panel.

A related art LCD device having an LCD panel and a data driving circuit will be described with reference to the accompanying drawings.

FIG. 1 is a block diagram of the related art LCD device.

As shown in FIG. 1, the LCD device includes an LCD panel 1 and a data driving circuit 2. In the LCD panel 1, gate and data drivers 1*a* and 1*b* are formed in a peripheral region of a pixel array in a pixel region of a matrix, by arranging a plurality of gate and data lines. The data driving circuit 2 provides data to the LCD panel 1.

The data driving circuit 2 includes a timing controller 3, a level shifter 4, a digital to analog converter 5, a common voltage amplifier 6, and a power supply 7. The timing controller 3 formats input data, such as display data R, G, and B having, for example, one bit, four bits, or six bits, vertically and horizontally synchronized signals Vsync and Hsync, a clock signal DCLK, and a control signal DTEN. The formatted data is output to the gate and data drivers 1*a* and 1*b* so that the respective gate and data drivers 1*a* and 1*b* can display a picture image. The level shifter 4 amplifies voltage levels of the clock signal DCLK and the control signal DTEN among the signals output from the timing controller 3. The digital to analog converter 5 converts digital display signals output from the timing controller 3 to analog signals that are appropriate for a liquid crystal driving voltage, and then outputs the analog signals to the LCD panel 1. The common voltage amplifier 6 amplifies a common voltage, and supplies the common voltage to the LCD panel 1 through the power supply 7.

The timing controller 3 may further include a frame memory. Although not shown, two transparent substrates (glass substrates) are attached to each other and are separated by a constant distance, and a liquid crystal is injected between the two transparent substrates, thereby forming the LCD panel.

One of the two transparent substrates includes a plurality of gate lines, each of which are separated by a constant distance from one another. A plurality of data lines cross the gate lines and are also separated by a constant distance from one another. A plurality of pixel electrodes are formed in each pixel region of a matrix which includes the gate and data lines. A plurality of TFTs apply signals from the data lines to the pixel electrodes according to a signal of the gate line. The other transparent substrate includes a color filter film, a common electrode, and a black matrix film.

For LCD panels having the above structure, a circuit structure of a low polysilicon LCD panel is shown in FIG. 2.

Referring to FIG. 2, the LCD panel 1 includes a pixel array, a plurality of first shift registers 11 and first buffers 12, a plurality of second shift registers 13 and second buffers 14, a plurality of signal lines 15, and a plurality of switching devices 16.

In the pixel array, a plurality of gate lines G1–Gm vertically cross a plurality of data lines D1–Dn. The first shift registers 11 and the buffers 12 provide scan signals to each gate line. Each data line is divided into k blocks, and a unit second shift register 13 and a unit buffer 14 are formed in each block of the data line to drive the data line. The plurality of signal lines 15 transmit the image signals output from the digital to analog converter 5 of the data driving circuit 2 to each data line. The plurality of switching devices 16 sequentially apply the image signals of the signal lines 15 to the data lines in order of each block in accordance with driving signals output from the second shift registers 13 and the second buffers 14.

Unlike existing amorphous silicon data driving circuits, the data driving circuit of the low polysilicon TFT LCD panel divides a plurality of data lines into blocks to reduce the number of contact lines between an external circuit and the LCD panel when selecting the gate line, and then sequentially supplies display voltages to the data line.

Accordingly, the digital to analog converter requires a driving capability that can charge the data line for a shorter time as compared with amorphous silicon data driving circuits. To obtain the driving capability, the amplifying driving capability of the digital to analog converter has to be improved. To improve the amplifying driving capability, a standby current has to be increased.

The operation of the aforementioned LCD device will be described with reference to FIG. 3.

Pulse signals g1 and g2 are sequentially applied to each gate line by a gate start signal GSTART and clock signals GCLK and GCLKB. Then, data signals d1 and d2 are applied to each data line by a data start signal DSTART and clock signals DCLK and DCLKB to turn on the switching devices 16, thereby providing image signals of the signal lines 15 to each data line.

At this time, the data driving circuit repeats the operation in each pulse section. That is, the data driving circuit performs the operation of the section "a" in the unit gate pulse section. Accordingly, the driving capability of the data driving circuit of the low polysilicon LCD panel has to be improved as compared with that of the data driving circuit of the amorphous silicon LCD panel.

However, the data driving circuit of the related art LCD device has the following problems.

In general, in electronic devices such as notebook computers and mobile phones having an LCD device, image signals of full color or multigray (over 64 gray) are not always displayed. For example, in a standby mode of mobile phones, a low gray image signal of, for example, letters is displayed.

In electronic devices displaying image signals of full color, multigray level, or low gray level, the data driving circuit of the related art LCD device has only one digital to analog converter having a constant speed and standby current regardless of a gray level of an image picture displayed.

Having only one digital to analog converter regardless of the gray level of the image displayed causes unnecessary power consumption.

If the data driving circuit includes a digital to analog converter that displays image signals of full color or a multigray level, even though image signals having a low gray level are displayed, the single digital to analog converter causes a consumption of power corresponding to that of multigray image signals. Accordingly, it is desirable to reduce power consumption in such electronic devices.

SUMMARY OF THE INVENTION

Accordingly, the present invention is directed to a data driving circuit of an LCD device that substantially obviates one or more problems due to limitations and disadvantages of the related art.

An object of the present invention is to provide a data driving circuit of an LCD device, in which a mode is selected based on a color gray level of an image signal displayed, and then a plurality of digital to analog converters are formed to be selectively driven in the selected mode, thereby reducing power consumption.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these objects and other advantages and in accordance with the purpose of the invention, as embodied and broadly described herein, a data driving circuit of an LCD device includes a timing controller for formatting input data so that data and gate drivers of an LCD panel display a picture image, and outputting a selection signal; a plurality of digital to analog converters for converting digital signals output from the timing controller to analog signals based on a color gray level displayed; and a plurality of amplifiers for amplifying the signals output from the respective digital to analog converters and outputting the amplified signals to the LCD panel.

In another aspect the invention, the data driving circuit of an LCD device includes a timing controller for formatting input data so that data and gate drivers of an LCD panel display a picture image, and outputting a selection signal; a level shifter for amplifying voltage levels of signals output from the timing controller; a plurality of digital to analog converters for converting digital signals output from the level shifter to analog signals based on a color gray level displayed; a plurality of amplifiers for amplifying the signals output from the respective digital to analog converters and outputting the amplified signals to the LCD panel; and a plurality of multiplexers for selecting a signal output from one of the plurality of amplifiers in accordance with the selection signal of the timing controller and outputting the selected signal to the LCD panel.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiment(s) of the invention and together with the description serve to explain the principles of the invention.

DETAILED DESCRIPTION OF THE PREFERRED EMBODIMENTS

Reference will now be made in detail to the preferred embodiments of the present invention, examples of which are illustrated in the accompanying drawings.

Figure 4:
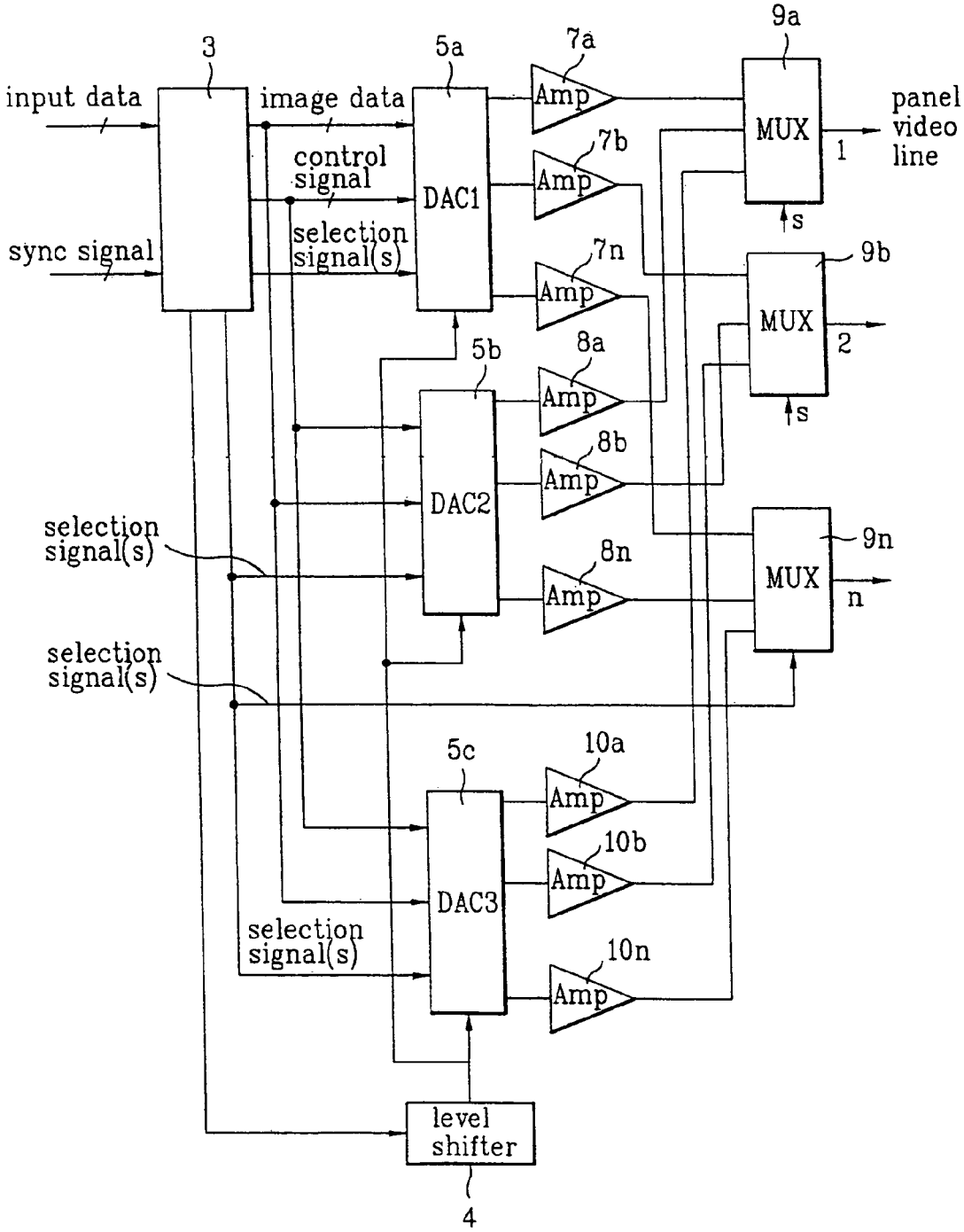
FIG. 4 is a data driving circuit diagram of an LCD device according to the present invention.

FIG. 4 is a data driving circuit diagram of an LCD device according to the present invention.

The LCD panel of the present invention has the same basic structure as the related art LCD panel, so that a description of the LCD panel according to the present invention will be omitted. A data driving circuit of the LCD device according to the present invention will be described.

The data driving circuit according to the present invention includes a timing controller 3, a level shifter 4, a plurality of digital to analog converters 5*a*, 5*b*, and 5*c*, a plurality of amplifiers 7*a*, 7*b* to 7*n*, 8*a*, 8*b* to 8*n*, 10, 10*b* to 10*n*, and a plurality of 2×1 multiplexers 9*a*, 9*b* to 9*n*, a common voltage amplifier (not shown), and a power supply (not shown).

The timing controller 3 formats input data such as display data R, G and B having, for example, one bit, four bits, or six bits, vertically and horizontally synchronized signals Vsync and Hsync, a clock signal DCLK and a control signal DTEN, and outputs the formatted data to the gate and data drivers so that the gate and data drivers display a picture image. Also, the timing controller 3 outputs a selection signal to select an appropriate converter to be driven. The level shifter 4 amplifies the voltage levels of the clock signal DCLK and the control signal DTEN among the signals output from the timing controller 3. Then, a plurality of digital to analog converters 5*a*, 5*b*, and 5*c* convert the signals output from the timing controller 3 to analog signals according to each gray level, for example, 64 gray (6 bit) and 2 gray (1 bit). The plurality of amplifiers 7*a*, 7*b* to 7*n*, 8*a*, 8*b* to 8*n*, and 10, 10*b* to 10*n* amplify the signals output from the respective digital to analog converters 5*a*, 5*b*, and 5*c*. Then, the plurality of 2×1 multiplexers 9*a*, 9*b* to 9*n* selects one of the amplified signals output from the first and second first, second, and third digital to analog converters 5*a*, 5*b*, and 5*c* based on the selection signal of the timing controller 3, and then outputs the selected signal to the LCD panel. The common voltage amplifier amplifies a common voltage, and supplies the common voltage amplified to the LCD panel.

The timing controller 3 includes a frame memory. The first digital to analog converter 5*a* obtains a multigray (64 gray (6 bit)) image, the second digital to analog converter 5*b* obtains a low gray (2 gray (1 bit)) image. If there is a third digital to analog converter 5*c* in addition to the first and second digital to analog converters 5*a* and 5*b*, then the first digital to analog converter 5*a* obtains a multigray (64 gray (6 bit)) image, the second digital to analog converter 5*b* obtains intermediate gray (16 gray (4 bit)) image, and the third digital to analog converter 5*c* obtains a low gray (2 gray (1 bit)) image.

Thus, a plurality of 3×1 multiplexers is formed, each of which selects one of three input signals, and then outputs the selected signal.

In the data driving circuit of the present invention, it is possible to operate only one digital to analog converter among a plurality of digital to analog converters, so that the data driving circuit is operated even though a plurality of multiplexers is not used.

Various modes are provided according to a bit of video input data, and then a plurality of digital to analog converters are formed according to the mode. Then, one digital to analog converter is selected depending on the mode, and the power supply of the other digital to analog converters is cut off.

Referring to FIG. 4, a method for driving data in a multigray mode and a low gray mode in the LCD device of the present invention will be described.

The display data and the control signals are input to the timing controller 3 from a system so that a gray level of the display data is recognized. Then, if the display data of a six bit displaying moving picture is input, the timing controller 3 formats the display data and control signals such as a synchronized signal, or a clock signal DCLK so that the gate and data drivers of the LCD panel display a picture image, and then outputs the formatted data. Subsequently, the first digital to analog converter is driven. At this time, a power supply to the second digital to analog converter is cut off.

Figure 1:
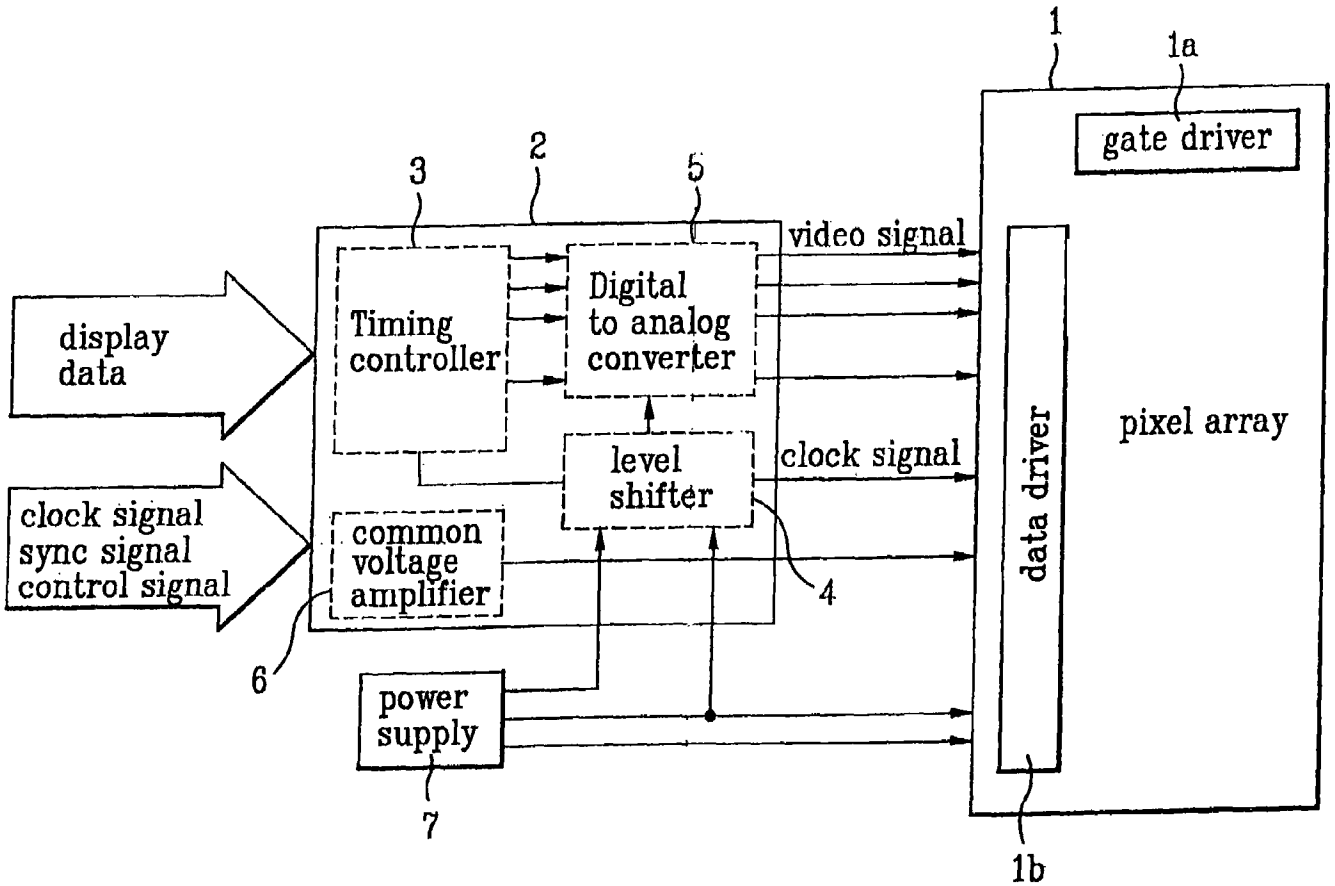
FIG. 1 PRIOR ART
FIG. 1 is a block diagram of a related art LCD device.
Figure 2:
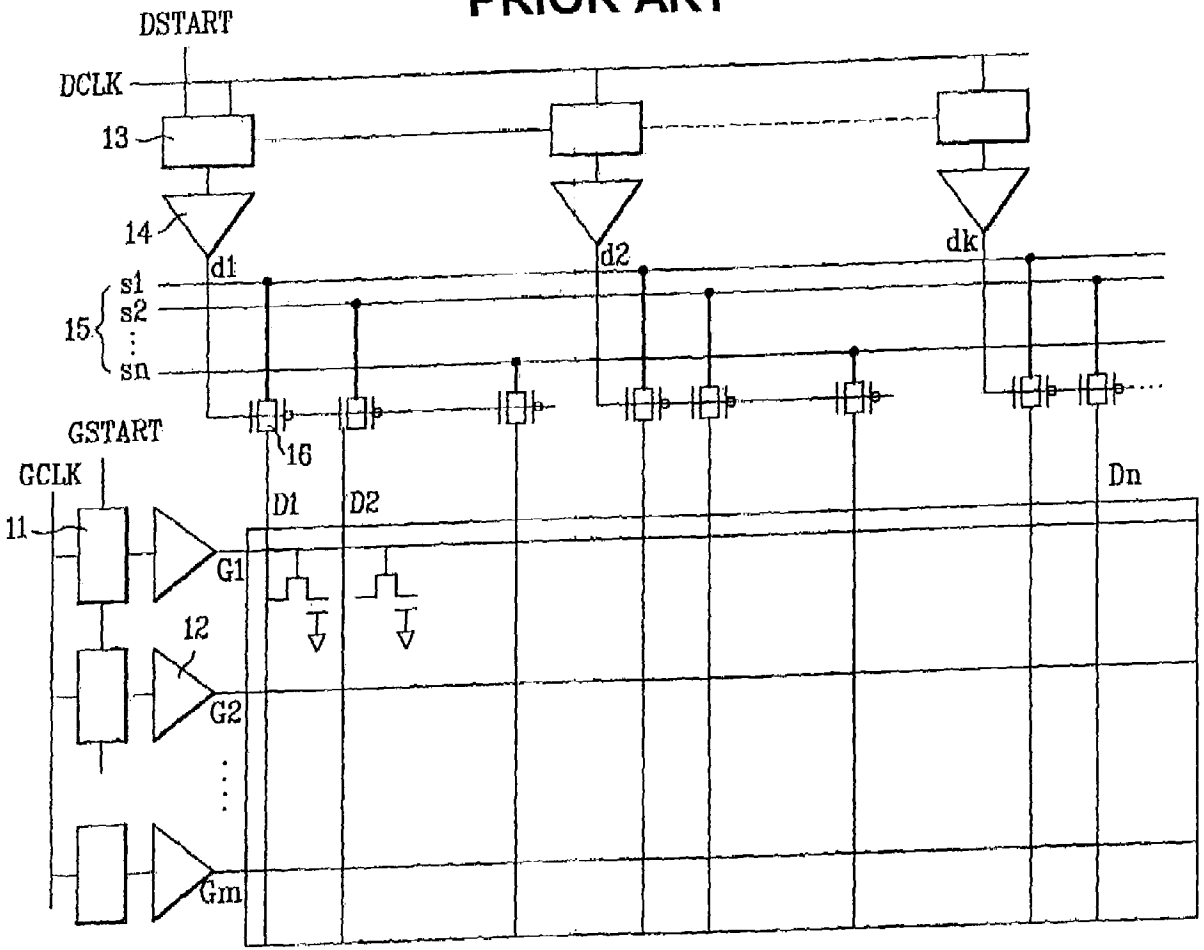
FIG. 2 PRIOR ART
FIG. 2 is a circuit diagram of a related art low poly silicon LCD panel.
Figure 3:
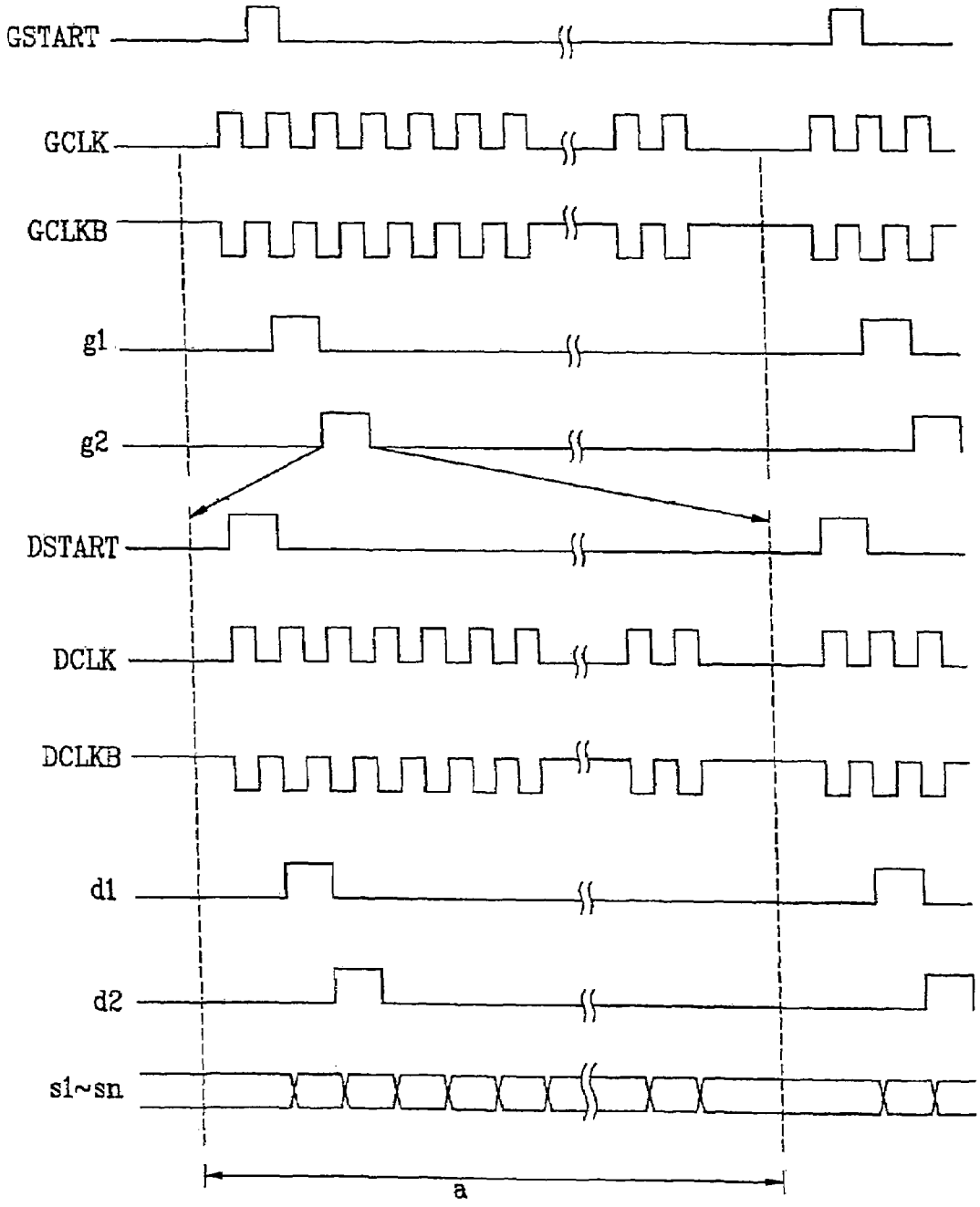
FIG. 3 PRIOR ART
FIG. 3 is an operation timing view of a related art LCD panel.

The first digital to analog converter 5*a* is driven for providing the signal output from the first digital to analog converter 5*a* to the signal lines 15 of FIG. 2, thereby displaying a picture image on the LCD panel.

Meanwhile, the display data of the low gray level, such as a standby mode of a mobile phones, for example, is input to the timing controller 3. The timing controller 3 formats the display data and control signals, such as a synchronized signal, or a clock signal DCLK so that the gate and data drivers of the LCD panel display a picture image, and then outputs the formatted data. Subsequently, the second digital to analog converter 5*b* is driven. At this time, a power supply to the first digital to analog converter is cut off.

The second digital to analog converter 5*b* is driven to supply the signal output from the second digital to analog converter 5*b* to the signal lines 15 of FIG. 2 through the amplifier and the multiplexer, thereby displaying a picture image on the LCD panel.

The data driving circuit of the LCD device and the method for forming the same according to the present invention can be applicable not only to low poly silicon TFT LCD devices but also to existing amorphous silicon TFT LCD devices. Also, the system may provide a gray level of the display data to the timing controller, or the timing controller may recognize the gray level of the display data itself.

The data driving circuit of the LCD device according to the present invention has the following advantages.

In general, mobile phones of the related art may display a moving picture of the multigray level, or letters and simple graphics of the low gray level. If the letters or simple graphics of the low gray level are displayed by driving the digital to analog converter to obtain the multigray level, unnecessary power consumption is used.

In the LCD panel of the present invention, however, three modes, for example, are provided based on the gray level of the display data: a multigray mode, an intermediate gray mode, and a low gray mode. A digital to analog converter corresponds to each gray level. One of the digital to analog converters is selected based on the gray level of the display data, and is driven. Then, the power supply to the other digital to analog converters is cut off. Accordingly, it is possible to reduce unnecessary power consumption.

When the multigray mode picture image of a moving picture is displayed on a mobile phone, for example, the signal has to be refreshed fifteen times or more a second, so that a flicker is not generated in the picture.

In the meantime, when the low gray mode picture image of the letters or the simple graphics is displayed on the mobile phone, the signal has to be refreshed from five to ten times a second, so that a flicker is not generated in the picture. Accordingly, the time required for formatting the low gray picture image in the digital to analog converter is reduced as compared to the time allowed for formatting the multigray mode picture image, thereby reducing the power consumption of the digital to analog converter for the low gray picture mode.

It will be apparent to those skilled in the art that various modifications and variations can be made in the data driving circuit of an LCD device of the present invention without departing from the spirit or scope of the invention. Thus, it is intended that the present invention cover the modifications and variations of this invention provided they come within the scope of the appended claims and their equivalents.

What is claimed is:

1. A data driving circuit of an LCD device comprising:

a timing controller for formatting input data so that data and gate drivers of an LCD panel display a picture image, and outputting a selection signal;

a plurality of digital to analog converters for converting digital image signals output from the timing controller to analog image signals based on a number of bits corresponding to a gray level displayed and for receiving the selection signal; and a plurality of amplifiers for amplifying the analog image signals output from the respective digital to analog converters and outputting the amplified image signals to the LCD panel, wherein the selection signal selects an appropriate converter of the plurality of digital to analog converters to be driven according to the number of bits corresponding to the gray level.

2. The data driving circuit of the LCD device as claimed in claim 1, further comprising a plurality of multiplexers for selecting a signal output from one of the digital to analog converters in accordance with the selection signal of the timing controller and outputting the selected signal to the LCD panel.

3. The data driving circuit of the LCD device as claimed in claim 1, comprising a first digital to analog converter and a second digital to analog converter, the first digital to analog converter serving to obtain a multigray (64 gray or 6 bit) image, and the second digital to analog converter serving to obtain a low gray (2 gray, 1 bit) image.

4. The data driving circuit of the LCD device as claimed in claim 1, comprising a first digital to analog converter, a second digital to analog converter and a third digital to analog converter, the first digital to analog converter serving to obtain a multigray (64 gray or 6 bit) image, the second digital to analog converter serving to obtain an intermediate gray (16 gray or 4 bit) image, and the third digital to analog converter serving to obtain a low gray (2 gray or 1 bit) image.

5. A data driving circuit of an LCD device comprising:

a timing controller for formatting input data so that data and gate drivers of an LCD panel display a picture image, and outputting a selection signal;

a level shifter for amplifying voltage levels of signals output from the timing controller;

a plurality of digital to analog converters for converting digital image signals output from the level shifter to analog image signals based on a number of bits corresponding to a gray level displayed and for receiving the selection signal;

a plurality of amplifiers for amplifying the analog image signals output from the respective digital to analog converters and outputting the amplified image signals to the LCD panel; and a plurality of multiplexers for selecting a signal output from one of the plurality of amplifiers in accordance with the selection signal of the timing controller and outputting the selected signal to the LCD panel, wherein the selection signal selects an appropriate converter of the plurality of digital to analog converters to be driven according to the gray level.

6. The data driving circuit of the LCD device as claimed in claim 5, comprising a first digital to analog converter and a second digital to analog converter, the first digital to analog converter serving to obtain a multigray (64 gray or 6 bit) image, and the second digital to analog converter serving to obtain a low gray (2 gray, 1 bit) image.

7. The data driving circuit of the LCD device as claimed in claim 5, comprising a first digital to analog converter, a second digital to analog converter and a third digital to analog converter, the first digital to analog converter serving to obtain a multigray (64 gray or 6 bit) image, the second digital to analog converter serving to obtain an intermediate gray (16 gray or 4 bit) image, and the third digital to analog converter serving to obtain a low gray (2 gray or 1 bit) image.

* * * * *